US012398566B2

(12) United States Patent
Casey

(10) Patent No.: US 12,398,566 B2
(45) Date of Patent: Aug. 26, 2025

(54) SLOPED ROOF HEATING APPARATUS AND METHODS OF MAKING AND USE

(71) Applicant: Brian T. Casey, Tahoe City, CA (US)

(72) Inventor: Brian T. Casey, Tahoe City, CA (US)

( * ) Notice: Subject to any disclaimer, the term of this patent is extended or adjusted under 35 U.S.C. 154(b) by 822 days.

(21) Appl. No.: 17/706,275

(22) Filed: Mar. 28, 2022

(65) Prior Publication Data

US 2022/0307265 A1 Sep. 29, 2022

Related U.S. Application Data

(60) Provisional application No. 63/167,518, filed on Mar. 29, 2021.

(51) Int. Cl.
*E04D 13/10* (2006.01)

(52) U.S. Cl.
CPC ..... *E04D 13/103* (2013.01)

(58) Field of Classification Search
CPC .... E04D 13/103; H05B 1/0238; H05B 3/342; H05B 3/56; H05B 2203/015; H05B 2203/011; H05B 3/34; H05B 2203/014; H05B 2203/005; H05B 2214/04; H05B 2203/017; H05B 2203/003; H05B 2203/029
USPC ..... 219/200, 202, 209, 217, 212, 211, 528, 219/553, 552, 541, 538, 529
See application file for complete search history.

(56) References Cited

U.S. PATENT DOCUMENTS 8,946,601 B2 * 2/2015 Casey ..... H05B 3/06 219/547
9,045,907 B2 * 6/2015 Clark ..... E04D 13/106

* cited by examiner

*Primary Examiner* — Phuong T Nguyen
(74) *Attorney, Agent, or Firm* — Holland & Hart LLP

(57) ABSTRACT

A roof ice melt system and method of making and use to reduce or eliminate water from puddling or not running down the ice melt system and off of the roof. One embodiment of the roof for the roof ice melt system can has a slope of between approximately 0.5/12 and approximately 2.5/12. The roof ice melt system has a heating element and heatable cover panel having a a primary heating element cover section, an upper roof contacting section, and an intermediate cover section extending between the primary heating element cover section and the upper roof contacting section. The intermediate cover section is sized so that it extends downwardly along the roof, rather than horizontally or higher, from the upper roof contacting section toward the primary heating element cover section.

20 Claims, 5 Drawing Sheets

SLOPED ROOF HEATING APPARATUS AND METHODS OF MAKING AND USE

CROSS-REFERENCE TO RELATED APPLICATION

This application claims priority through the applicant's prior Provisional Patent Application, titled SLOPED ROOF HEATING APPARATUS AND METHODS OF MAKING AND USE, Ser. No. 63/167,518, filed Mar. 29, 2021, which Provisional Patent Application is incorporated by reference herein in its entirety. In the event, however, of any inconsistency between that Application and the present Application, the present Application shall govern.

FIELD OF TECHNOLOGY

This application is directed to roof heating apparatus for sloped roofs and methods of making and use.

BRIEF DESCRIPTION OF SOME ASPECTS OF THE BACKGROUND

This application incorporates by reference the applicant's prior art U.S. Pat. No. 8,946,601, issued Feb. 13, 2015, published on Apr. 19, 2012. With reference to FIGS. 1 and 2 of the present patent application, that prior art Patent discloses, among other things, the prior art ice melt system, generally 100, shown mounted to an underlying building roof section 102 in FIGS. 1 and 2. The prior art ice melt system includes (i) a metal (e.g., aluminum) cover panel 201, covering and in heat transfer contact with (ii) a lower metal (e.g., aluminum) heating element 203, which is secured to (iii) the lower roof section 102 by (iv) a metal (e.g., aluminum) fastener 205, and also has (v) a heating cable 207 extending through the lower heating element 203 to heat the heating element 103 when desired. One commonly used embodiment of the heating element 203 has height HE of approximately 11/16 inches.

The heating cable 207 can be attached to a source of electricity (not shown in FIG. 2) to generate heat in the heating cable 207, which in turn heats the heating element 203, which in turn heats the cover panel 201. The ice melt system can thus melt snow or ice that is on or adjacent the cover panel 201 or heating element 203.

The applicant believes that he discovered that FIGS. 1 and 2 prior art systems 100 can have problems when used on roof slopes that are lower than 3/12. An X/XX roof slope lowers by X inches over an XX inch distance, so a 3/12 roof slope lowers 3 inches over every 12 inch distance downwardly in a vertical plane penetrating the roof. As shown in FIG. 2, when the FIG. 2 embodiment is mounted to such a lower sloped roof, such as a 2/12 sloped roof 102 for example, that prior art system 100 can cause water 204 to accumulate in the V-shaped trough 206 created by planar tapered leg panel segment 208 extending upwardly toward the primary heating element cover panel section 210 from the abutting planar opposed upwardly extending upper roof cover section 212.

Thus, when snow falls, the heated cover panel 201 can cause snow landing in the trough 206 to melt and create the water puddle 204. Similarly, when rain falls, the rain can puddle in the trough 206 rather than flow downward and off of the lowermost edge 214 of the cover panel 201 spaced from the lowermost edge 216 of the roof 102.

For example, in some prior art systems, cover panels are often made in ten foot lengths. When a given ridge edge is longer than 10 feet long, which most roof edges are, more than one panel is used along the roof edge. The differing panels are mounted, however, to form a gap between adjacent panels, to accommodate expansion and contraction of the adjacent panels. The gap is covered with a splice cover panel spanning between, and mounted to abut the top of, adjacent differing panels. Water may puddle in the troughs of such systems and leak through to underlying structure.

With regard to FIG. 2, it should be understood that, as actually mounted to the roof 102, lowermost portions, e.g., 213, of the heating element 203 and the bottom side 215 of the upwardly extending top flange panel segment are actually in contact with, and abut, the roof 102. (See, e.g., FIG. 3 102, 203, 213.) They are shown as slightly spaced apart in FIG. 2 for ease of understanding of the differing structures shown in FIG. 2.

BRIEF DESCRIPTION OF SOME ASPECTS OF THIS SPECIFATION

As explained above, the applicant believes that he discovered problems with the prior art such as described above. Accordingly, the applicant has developed an improved ice melt system in which a cover panel covers an underlying heating element mountable to run along a roof, such as adjacent the edge of the roof, of a building roof having a slope of less than 3/12, such as adjacent the edge of the roof. The cover panel for such a roof is mountable to provide (i) a primary heating element cover section spaced from the roof by structure such as the heating element under heating element cover section and (i) an intermediate cover section extending at an angle from the primary heating element cover section toward an upper roof cover section and abutting an upper roof cover section above and spaced from the heating element. The intermediate cover section has a width sized with respect the spacing of the primary heating element cover section from the underlying roof to provide an upper surface on the intermediate cover section that extends toward the primary heating element cover section from the upper roof cover section at an angle less than horizontal, in order to provide a downwardly sloped upper surface on the intermediate cover section that will, in cooperation with gravity, cause water to drain water downwardly toward and onto the primary heating element cover section.

In some embodiments, the intermediate cover section is one side of a trough having the opposed trough side provided by the upper roof cover section mountable to abut the upper surface of the underlying upper roof cover section. In some embodiments, the intermediate cover section and upper roof cover section are planar, and the bottom of the trough when mounted to the roof can, in some embodiments, abut or be closely adjacent the upper roof cover section. The opposed planar sections of the trough can be mountable above or under other roof structure, such roofing tiles, roofing shingles, or other roof structure.

One method of use of some embodiments of the present ice melt system can include mounting a heating element to roof having a slope of less than 3/12 to run along and be adjacent to an edge of a roof. The method can include extending the length of certain otherwise upwardly sloped ice melt system structure, such as upper heating panel structure, with respect to horizontal when mounted to a given roof deck, with the resulting extended length of the structure then being downwardly sloping with respect to horizontal when mounted to the given roof deck.

There are other novel features and advantages of the present specification. They will become apparent as this specification proceeds. In this regard, however, the scope of the present invention is to be determined by the claims as issued and not by whether a given feature or advantage is recited in this Brief Description section.

BRIEF DESCRIPTION OF THE DRAWINGS

Prior art and the applicant's preferred and other embodiments are shown in the accompanying drawings in which.

DETAILED DESCRIPTION OF SOME EMBODIMENTS

Figure 1:
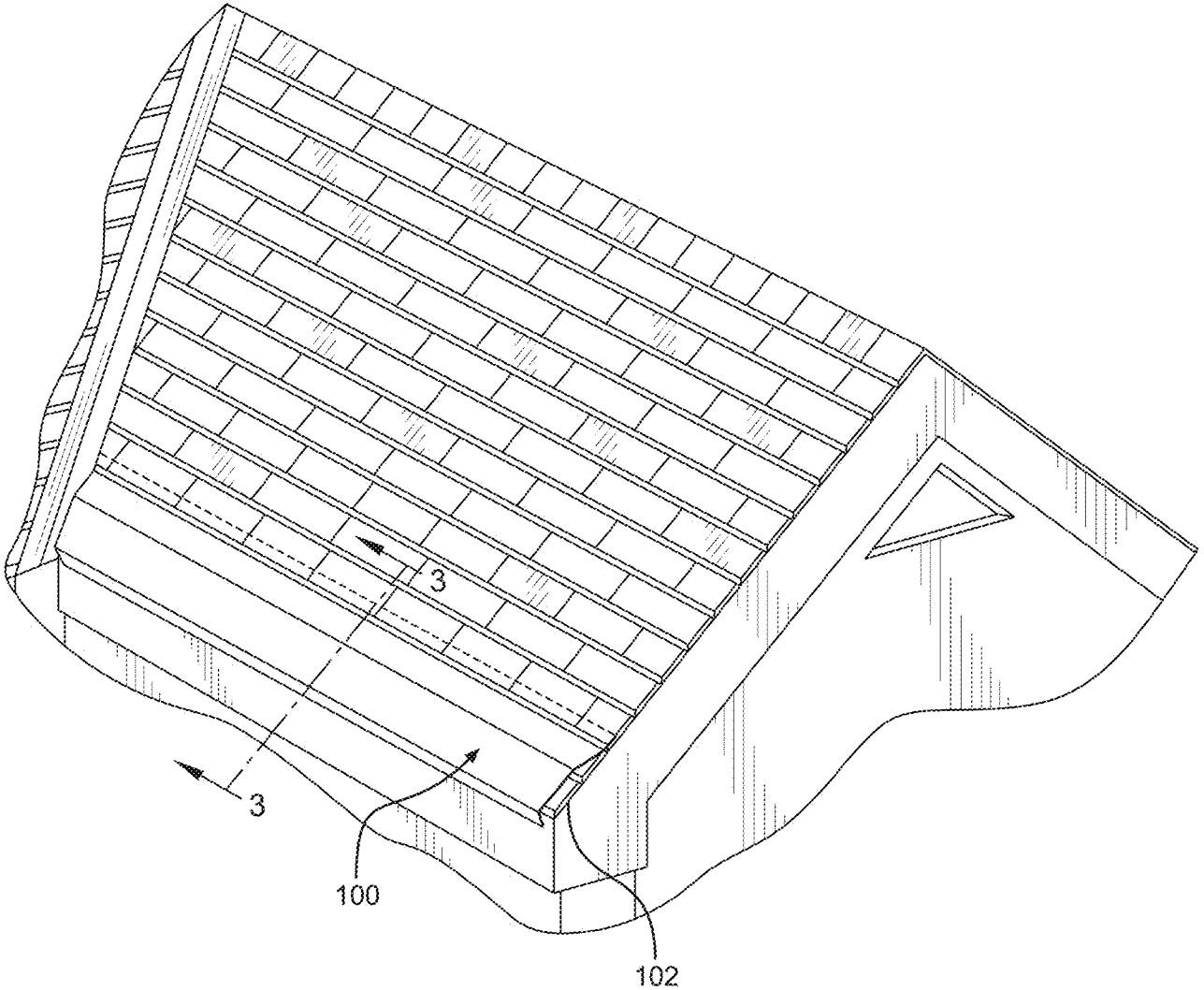
FIG. 1 (PRIOR ART)
FIG. 1 is a partial perspective view of a house on which a prior art ice melt system is mounted to surround the lower edge of a house roof and extend upwardly on the roof top to penetrate between lower row of roof shingles and the underlying roof.
Figure 2:
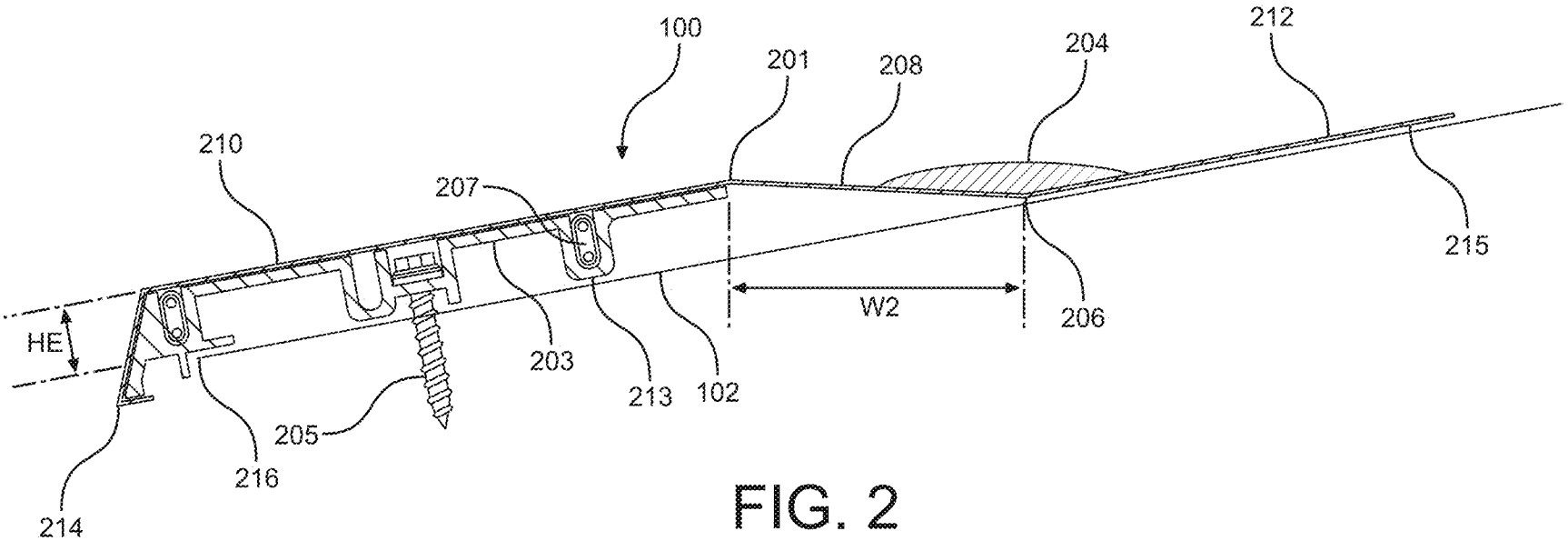
FIG. 2 (PRIOR ART)
FIG. 2 is a cross-sectional view of prior art ice melt system of FIG. 1 taken along section line 2-2 of FIG. 1.
Figure 3:
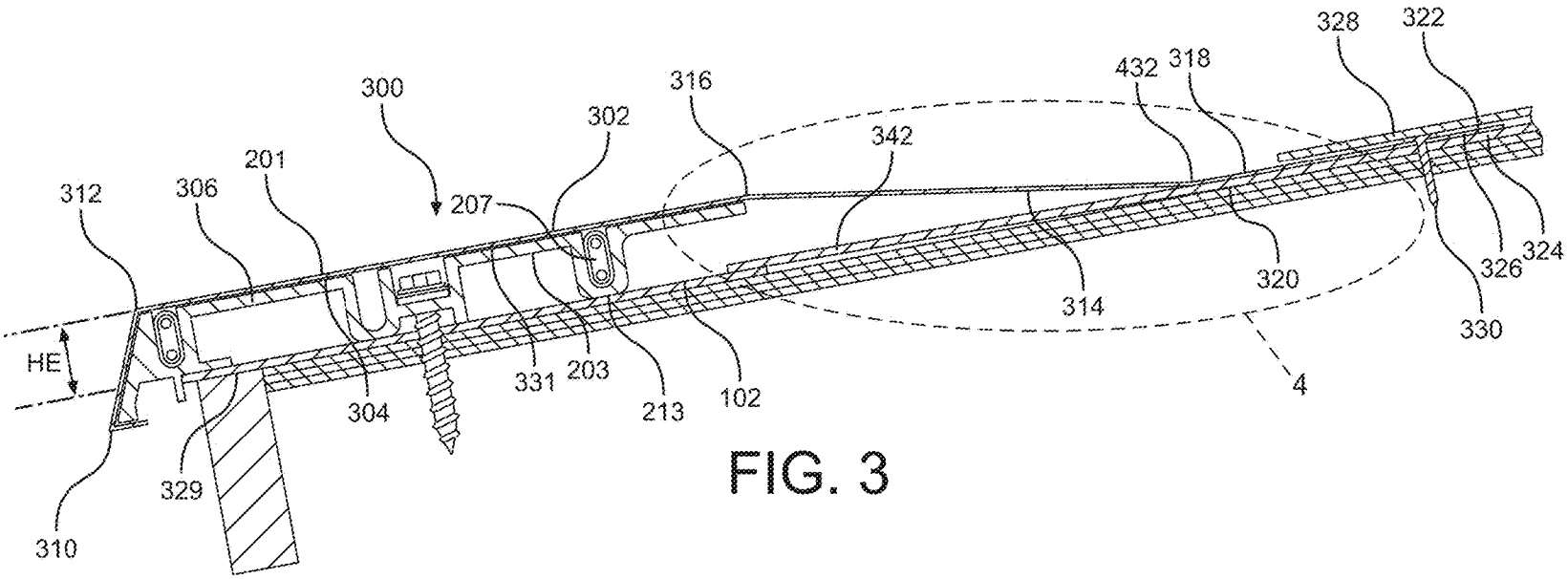
FIG. 3 is a cross sectional view of an embodiment of the present ice melt system mounted to a building roof having slope of 2/12 and roof shingles over which the ice melt system is mounted.

With reference to FIG. 3, an embodiment of the present ice melt system, generally 300, has a cover panel 302 formed from a planar aluminum sheet (not shown in FIG. 3). The cover panel 302 has a planar primary heating element cover section 302 adapted to abut, in its lower side 304, the upper somewhat planar side 306 of a mating heating element 203, which has a height HE of approximately 11/16 inches. The lowermost end 310 of the cover panel 302 extends from the lower end 312 of the primary heating cover section 302, and a planar tapered intermediate cover section 314 from the upper end 316 of the primary heating cover section 302. A planar upper roof cover section 318 extends from the upper end 320 of the tapered intermediate cover section 314 to penetrate in between and abut the top side 322 of an upper roof section 324 and the bottom side 326 of a row of roof shingles or tiles, e.g., 328. A nail fastener 330 may penetrate the upper roof cove section 318 perpendicularly to the upper roof section 318 underneath roof tile 328 to also penetrate the underlying upper roof section 318 and secure the cover panel 302 in position with respect to the underlying upper roof section 318 and heating element 203 covered by the cover panel 302.

The ice melt system 300 of FIG. 3 is typically a retrofit that is also mounted on top of lower rows of roof shingles, e.g., 329, 342. It is to be understood that the present ice melt system may utilize differing fastening techniques and on differing roof structures, such as on where there may be no such lower rows, e.g., 329, 342, below the ice melt system 300.

Figure 4:
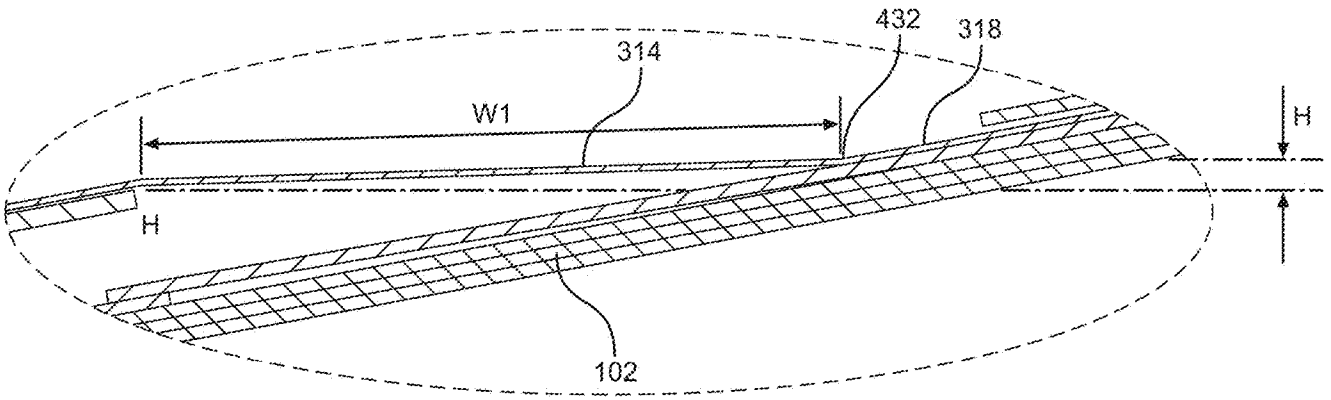
FIG. 4 is a partial and expanded cross-sectional view of the ice melt system of FIG. 3 with the intermediate cover section of a heatable cover panel extending downwardly from a point of contact with an upper roof cover section.

With reference now to FIG. 4, the cover panel has widened-V-shaped trough bottom 432 cooperatively formed by the opposed intermediate cover section 314 and upper roof cover section 318. The width W1 of the intermediate cover section 314 can be predetermined so that, when mounted on a building roof section 102 having a roof slope of less than 3/12, such as, for example, 2.8/12 down to as low as 0.5/12, provide an intermediate cover section 314 that extends at an angle θ downwardly from horizontal H-H.

For example, for a roof with a slope of 2/12, the width W1 can be 5 inches. When mounted to such a roof in fashion such as shown in FIGS. 3 and 4, this width will provide an angle θ that results in the intermediate section 314 sloping from the trough bottom 322 toward upper end 316 of the primary heating element cover section 302 downwardly at an angle from horizontal H-H of at least approximately 2 degrees.

Figure 5:
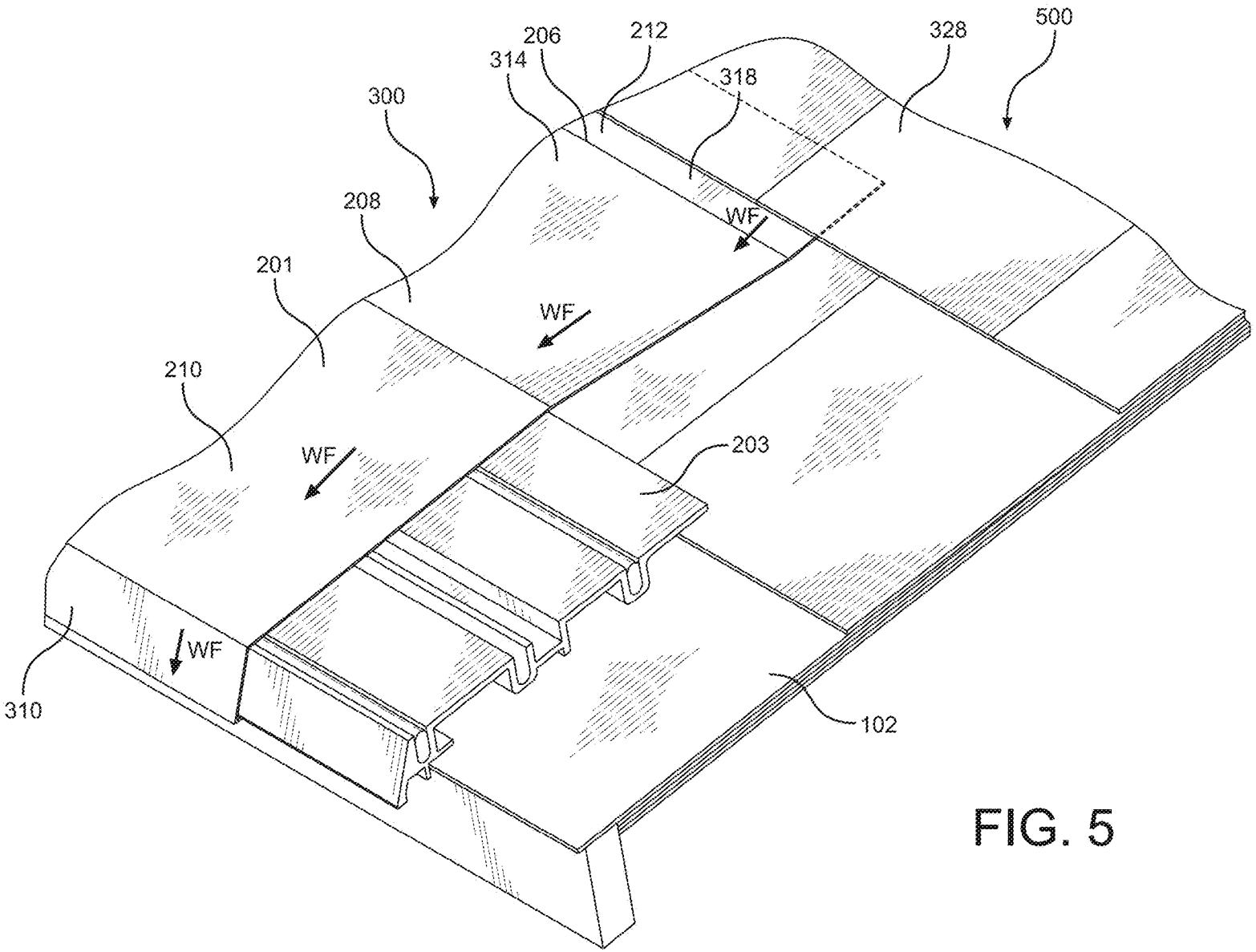
FIG. 5 is a partial perspective view of the partially assembled ice melt system of FIG. 3 mounted to an underlying roof deck having a roof slope of 2/12 and being adjacent to and partially under the lowermost edge of roof shingles mounted to the roof deck to rest on and abut the uppers surface of the upper roof cover section.

Thus, with reference to FIG. 5, applicant's present invention extends the width of the intermediate cover section 208, as compared to the shorter 3 inch width of prior art such sections, so that, when the thus-altered ice melt system 300 is mounted to a 2/12 sloped roof for example, the intermediate cover section 208 does not extend upwardly and instead extends downwardly with respect to horizontal. In cooperation with gravity, this drives rain or melt water flow WF down the respective top sides of the downwardly sloped (i) roof shingles, e.g., 328, (ii) upper roof cover section 318, (iii) intermediate cover section 314, (iv) primary heating element cover section 302, and (v) lowermost end 310 of the cover panel 302, thereby (vi) running off of the cover panel lowermost end 310 and building roof structure generally 500.

Figure 6:
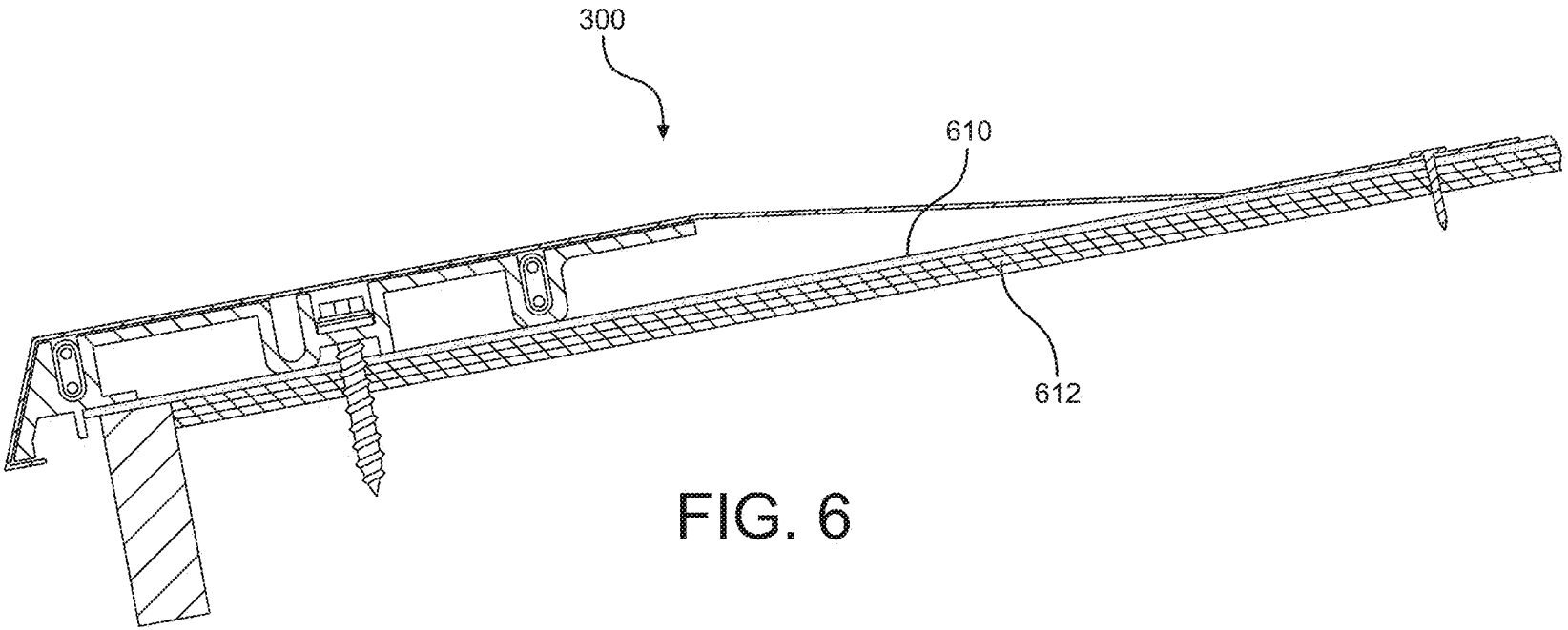
FIG. 6 is a is a cross sectional view of the FIG. 3 embodiment of the present ice melt system mounted to a building roof having slope of 2/12 and a membrane over the roof underlayment without shingles on the roof.

With reference now to FIG. 6, the present ice melt system, generally 300, can be similarly structured and mounted to other roof structures such as to a roof membrane 610 above a roof underlayment 612.

The method of making the present ice melt system therefore can include predetermining the length of an intermediate cover section, e.g., 314 in FIG. 3, and extending it, or alternatively shorting it, in view of the slope of the roof deck on which the ice melt system will be mounted and the height HE of the heating element 203 (that is, the distance from the upper side 331 of underlying building roof section 102 to the underside 331 of the primary heating element section). The extension or shortening should be sufficient to ensure that the upper surface of the intermediate section 3134 will slope sufficiently downwardly when the ice melt system is mounted to the particular sloped roof deck.

Again, alternatively, the length of the intermediate cover section 314 can be predetermined to be sufficiently long to slope downwardly on virtually any sloped roof, such as a 0.5/12 or 1/12 roof slope. Such a predetermined length would then similarly provide sufficient downward sloping along roofs having greater roof slopes, such as 2/12 or higher.

Embodiments the present apparatus and methods of making and use can eliminate or substantially reduce the problem of water becoming trapped in the exemplary prior art Pro® ice melt system and other ice melt systems presenting similar problems. By extending the length of certain otherwise upwardly sloped ice melt system structure with respect to horizontal when mounted to a given roof deck, the resulting extended length of the structure can then be downwardly sloping with respect to horizontal when mounted to the given roof deck.

In addition, in the accompanying FIG. 5 for example, the upper roof cover section 318 and intermediate cover section 314, are shown as planar and forming a widened V-shape in cross-section. The cross-section can be differently shaped, such as by rounding or curving the junction of these two sections. Similarly, alternative upper roof cover sections and intermediate covers sections, as well as other structures, such as the roof cover panel, can be non-planer, such as by having a rounded shape in cross-sectional view. In addition, for example, the junction of the primary heating element cover section and the intermediate cover section can be rounded or curved. The objective to be maintained is to prevent having a trough or similar structure causing water to remain and not flow downwardly off of the cover panel.

Similarly, the principles discussed above can be used in the method of making of one or more cover panels to reduce or eliminate non-water-puddling cover panels for one or more differently shaped heating elements (and related cooperative structure) presenting, in their one or more prior art or other forms, water puddling due to cover panel rise or spacing away from top side of an building roof section caused by having one or more heating elements intermediate the cover panel and top side of the underlying building roof section below the level of one or more upper portions of the cover panel extending upwardly along a roof. The present method of making takes that rise (for example, H-H with respect to prior art heating element 203 in FIGS. 2-6) into account in order to alter the panel structure to be located above the heating element along sloped roof to reduce or eliminate water puddling in the latter panel structure.

In this regard, while the cover panel shown in FIGS. 2-6 is formed of unitary sheet of material, such as metal sheeting for example, a cover panel assembly could be provided, having differing sections mountable or mounted with respect to each other to yield the cover panel assembly.

The foregoing detailed description has described some specific embodiments. However, the illustrative discussions above are not intended to be exhaustive or to limit the invention to the precise forms disclosed. Many modifications and variations are possible in view of the above teachings. The embodiments were chosen and described in order to explain the principles of the present systems and methods and their practical applications, to thereby enable others skilled in the art to best utilize the present systems, their components, and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon." Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C).

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A method of making a roof ice melt system for a roof having a slope of between 0.5/12 and 2.5/12 to provide:

a heating element mountable to the roof, the heating element having a bottom side mountable to an upper roof surface, a top side opposite the bottom side, and a height between top side and bottom side;

a heatable cover panel having a primary heating element cover section, an upper roof contacting section, and an intermediate cover section extending between at least a portion of the primary heating element cover section and the upper roof contacting section;

the method comprising:

selecting the heatable cover panel have a predetermined width of the intermediate cover section extending between the primary heating element cover section and the upper roof contacting section so that, when the heating element of height is mounted to the roof and the heatable cover panel is mounted with the heating element cover section covering the heating element and the upper roof contacting section abutting an upper roof section above the heating element, the intermediate section extends downwardly from upper roof section at an angle from the upper roof section below horizontal.

2. The method of making a roof ice melt system of claim 1 wherein intermediate cover section is planar.

3. The method of making a roof ice melt system of claim 2 wherein the heatable cover panel is a unitary bent metal sheet.

4. The method of making a roof ice melt system of claim 2 wherein the heating element height is at least 0.50 inches.

5. The method of making a roof ice melt system of claim 4 wherein the intermediate cover section width is at least 4.5 inches.

6. The method of making a roof ice melt system of claim 1 wherein the upper roof contacting section is planar.

7. The method of making a roof ice melt system of claim 6 wherein the heatable cover panel is a unitary bent metal sheet.

8. The method of making a roof ice melt system of claim 1 wherein the primary heating element cover section is planar.

9. The method of making a roof ice melt system of claim 8 wherein the heatable cover panel is a unitary bent metal sheet.

10. The method of making a roof ice melt system of claim 9 wherein the heating height is at least 0.50 inches.

11. The method of making a roof ice melt system of claim 10 wherein the intermediate cover section width is at least 4.5 inches.

12. The method of making a roof ice melt system of claim 8 wherein the heating element height is at least 0.50 inches.

13. The method of making a roof ice melt system of claim 12 wherein the intermediate cover section width is at least 4.50 inches.

14. The method of making a roof ice melt system of claim 1 wherein the heating element height is at least 0.50 inches.

15. The method of making a roof ice melt system of claim 14 wherein the intermediate cover section width is at least 4.5 inches.

16. A roof ice melt system mounted on a roof section having a slope of between 0.5/12 and 2.5/12, the roof ice melt system comprising:

a heating element mounted to the roof section with the bottom side mounted to an upper roof surface on the roof section and a top side opposite the bottom side, the heating element having height of at least 0.5 inches between top side and bottom side;

a heatable cover panel having a primary heating element cover section abutting the upper heating element side, an upper roof contacting section abutting an upper portion of the roof section above and spaced from the heating element, and an intermediate cover section extending between the primary heating element cover section and the upper roof contacting section;

the heatable cover panel having a predetermined width of the intermediate cover section extending between the primary heating element cover section and the upper roof contacting section is at least 4.5 inches;

wherein the width of the intermediate section is predetermined to extend downwardly from upper roof section to the primary heating element cover section at an angle from the upper roof section below horizontal.

17. The roof ice melt system of claim 16 wherein the heatable cover panel is a unitary bent metal sheet.

18. The roof ice melt system of claim 17 wherein the intermediate cover section is planar.

19. The roof ice melt system of claim 18 wherein the intermediate cover section is planar.

20. A roof ice melt system mounted on a roof section having a slope of between 0.5/12 and 2.5/12, the roof ice melt system comprising:

a heating element mounted to the roof section with the bottom side mounted to an upper roof surface on the roof section and a top side opposite the bottom side, the heating element having height of at least 0.5 inches between top side and bottom side;

a heatable cover panel having a primary heating element cover section abutting the upper heating element side, an upper roof contacting section abutting an upper portion of the roof section above and spaced from the heating element, and an intermediate cover section extending between the primary heating element cover section and the upper roof contacting section;

the heatable cover panel having a predetermined width of the intermediate cover section extending between the primary heating element cover section and the upper roof contacting section so that the intermediate section extends downwardly from upper roof section to the primary heating element cover section at an angle from the upper roof section below horizontal.

* * * * *